United States Patent [19]

Kyougoku et al.

[11] Patent Number: 4,882,463

[45] Date of Patent: Nov. 21, 1989

[54] FOOD VESSEL USING HEATING ELEMENT FOR MICROWAVE OVEN

[75] Inventors: Nobuo Kyougoku; Hitoshi Harada, both of Osaka, Japan

[73] Assignee: Suntory Limited, Osaka, Japan

[21] Appl. No.: 262,977

[22] Filed: Oct. 26, 1988

[30] Foreign Application Priority Data

Oct. 30, 1987 [JP] Japan ..... 62-275410

[51] Int. Cl.[4] ..... H05B 6/80

[52] U.S. Cl. ..... 219/10.55 E; 219/10.55 F; 426/107; 426/128; 426/234; 426/243; 99/DIG. 14

[58] Field of Search ..... 219/10.55 E, 10.55 F, 219/10.55 R; 426/128, 107, 113, 114, 241, 243, 234; 99/DIG. 14

[56] References Cited

U.S. PATENT DOCUMENTS

| | | | |
|---|---|---|---|
| 3,734,749 | 5/1973 | Bridgford | 426/128 X |
| 4,267,420 | 5/1981 | Brastad | 219/10.55 E |
| 4,571,340 | 2/1986 | Ferrante et al. | 426/113 X |
| 4,590,078 | 5/1986 | Umina | 426/113 |
| 4,594,492 | 6/1986 | Maroszek | 426/113 X |
| 4,626,641 | 12/1986 | Brown | 219/10.55 E |
| 4,663,506 | 5/1987 | Bowen et al. | 219/10.55 E |
| 4,841,112 | 6/1989 | Peleg | 219/10.55 E |

FOREIGN PATENT DOCUMENTS

| | | |
|---|---|---|
| 47-31229 | 11/1972 | Japan . |
| 47-31230 | 11/1972 | Japan . |
| 47-40338 | 12/1972 | Japan . |
| 49-46240 | 5/1974 | Japan . |
| 52-22340 | 8/1977 | Japan . |
| 62-98123 | 5/1987 | Japan . |
| 62-98124 | 5/1987 | Japan . |

OTHER PUBLICATIONS

"Microwavable Foods–Industry's Response to Consumer Demands for Convenience", Food Technology, Jun. 1987, pp. 52–62.

*Primary Examiner*—Philip H. Leung

*Attorney, Agent, or Firm*—Bachman & LaPointe

[57] ABSTRACT

A food vessel comprising a heating element for use in a household microwave oven is provided. The heating element is made of paper and a dielectric material such as aluminum foil. When bread dough or so forth is put into the vessel to be heated in the microwave oven, temperature of the heating element rapidly increases to a desired value and the bread dough rises while remaining in contact with the heating element. A uniformly browned loaf of bread of any desired configuration can thus be produced.

32 Claims, 7 Drawing Sheets

FOOD VESSEL USING HEATING ELEMENT FOR MICROWAVE OVEN

BACKGROUND OF THE INVENTION

The present invention relates generally to a food vessel for a microwave oven. More specifically, the invention relates to a food vessel for instantaneously increasing temperature of a heat element provided on the inner surface thereof so as to cook and brown an expandable food therein without preheating the oven.

While bread, cake, or crackers are generally made by means of an oven, the baking of bread requires a lot of time for preheating the oven in order to increase the temperature in the oven to a desired value which is suitable for baking. In recent years, a household microwave ovens have become popular because of their convenience, safety, and availability. Unlike older types of ovens, microwave ovens tend to heat food from the inside out. Therefore, when bread dough is cooked by means of a microwave oven, it can be heated instantaneously, but the surface of the bread cannot be browned or made crisp. For this reason, a baking and browning method of the expandable food such as bread applicable for microwave ovens is being developed. For example, a film type heating element is available for browning. A package type frozen food using the heating element, for example, a pizza appears on the market. There is however a problem that when the expandable food is baked, only part of the surface thereof comes in contact with the heating element and therefore the surface becomes unevenly browned.

Therefore, a food vessel which facilitates utilization of a microwave oven for baking bread dough and browning it uniformly is sought.

SUMMARY OF THE INVENTION

It is an object of the invention to provide a food vessel in which expandable food such as bread, cake, or cookies can be cooked and browned in a microwave oven.

According to one aspect of the present invention, there is provided a food vessel for baking dough of an expandable food in a microwave oven comprising a heat resistant vessel body having an opening and a lid for covering the opening, the body allowing the dough to expand therein, and a heating element, arranged on the inner surfaces of the vessel body and the lid, designed so as to keep in contact with the outer surface of the dough according to its expansion, the element being responsive to irradiation of microwaves by the oven to generate heat for baking the dough in the vessel body.

According to another aspect of the invention, there is provided a food vessel for baking dough of an expandable food in a microwave oven comprising a vessel body having an opening, the vessel body receiving the dough of expandable food therein, a lid section for covering the opening, the lid section being movable so as to allow the dough to expand in the vessel body, and a heating element provided on the inner surfaces of the vessel body and the lid section, wherein the temperature of the heating element can be brought to a desired value, by irradiation of microwaves by the oven, to bake the dough.

BRIEF DESCRIPTION OF THE DRAWINGS

The present invention will be understood from the detailed description given hereinbelow and from the accompanying drawings of the preferred embodiment of the invention, which, however, should not be taken to limit the invention to the specific embodiment but are for explanation and understanding only.

DESCRIPTION OF THE PREFERRED EMBODIMENT

Figure 1:
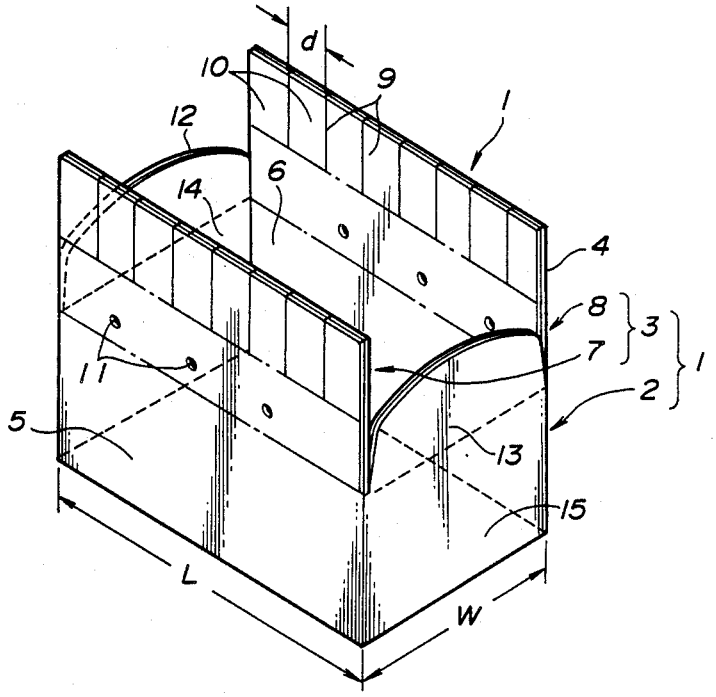
FIG. 1 is a perspective view showing a food vessel according to a first embodiment of the invention with its lid open.

Referring now to the drawings, in particular to FIGS. 1 to 4, a food vessel 1 for a microwave oven, according to the present invention, comprises a heat resistant vessel body 2 in which expanding dough such as bread dough, cake batter, and cookie dough is put and baked and a lid section 3 for covering the vessel body. The food vessel 1 further includes a heating element 4 in which the irradiation of microwaves produces eddy current to generate heat. The heating element 4 is attached on the interior surfaces of the vessel body 2 and the lid section 3.

Figure 2:
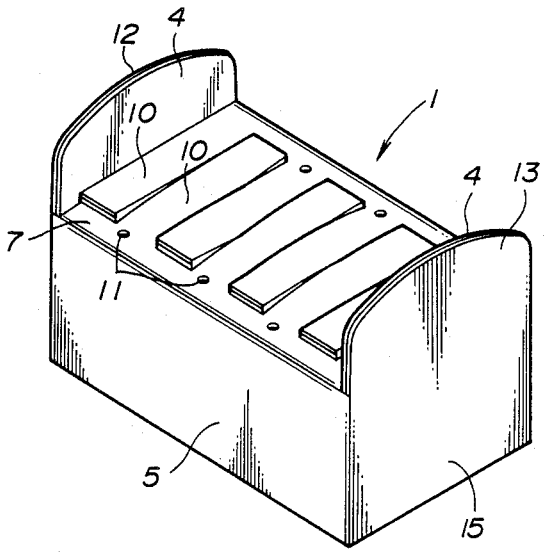
FIG. 2 is a perspective view showing a food vessel which its lid closed.
Figure 3:
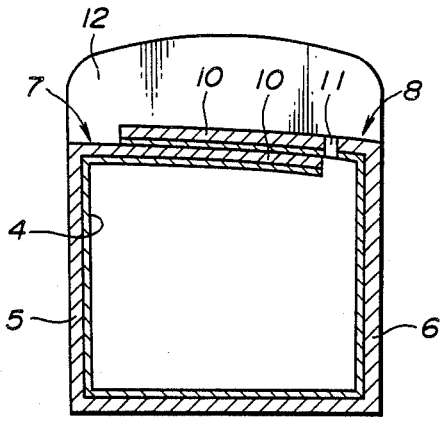
FIG. 3 is a section view of the food vessel of FIG. 2.

The vessel body 2 is made of paper board folded into the form of a rectangular parallelepiped box having an openable lid section. The height of the vessel is 10 cm, width is 10 cm, length is 15 cm, and its volume is 1500 $cm^3$. The lid section 3 comprises two lid members 7 and 8 which are provided at upper sections of the opposing side walls 5 and 6. The length L of the lid members 7 and 8 is approximately equal to that of the side walls 5 and 6 and the width W is approximately equal to that of the bottom of the vessel 1. In upper portions of the lid members 7 nd 8, a plurality of slits 9 are provided, separated by a predetermined distance d and thereby form a plurality of strip sections 10. The strip sections 10 alternately overlap, as shown in FIG. 2, to engage with each other, for covering the upper opening of the vessel 1. A plurality of vent holes 11 are formed at the base of the lid members 7 and 8 respectively. It will be noted that when the dough of an expandable food such as bread, cake, or cookies is expanded in the vessel body 2, the surface of the expanding dough contacts the interior surface of the lid section 3 and pressure due to expansion is exerted thereon to deform the lid sections.

End walls 14 and 15 have the flanges 12 and 13 extending upward therefrom. The flanges 12 and 13 function to cover the openings, which would otherwise be caused when the swelling of the bread pushes up the lid section 3, at the ends thereof to prevent the bread from swelling out from the vessel body 2.

Figure 4:
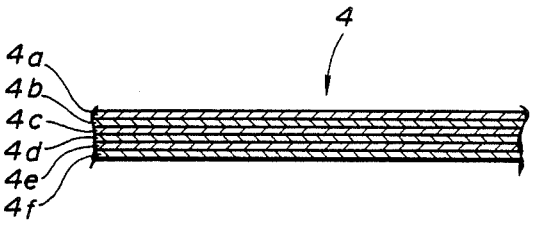
FIG. 4 is a section view of a heat element.

The heating element according to the invention is made of a dielectric material. For example, the element is formed with a polyester film or polyethylene terephthalate (PET) on which aluminum is vapor deposited. In the preferred embodiment, the heating element 4, as shown in FIG. 4, takes the form of a laminated sheet which comprises PET sheet 4*a*, aluminum foil 4*b*, paper 4*c*, PET sheet 4*d*, aluminum foil 4*e*, and paper 4*f* layered in sequence, and covers the entire interior surface of the vessel body 2, the lid section 3, and the side plates 12 and 13. The heating element 4 is attached by means of heat resistant adhesive material. The nature of the element 4 is such that irradiation of microwaves on the element causes eddy currents to generate heat and the temperature of the element can be brought instantaneously to 230 degrees C.

The layer structure of the heating element is, however, not limited to that described above. For example, the ordering of the layers of the heat element 4 may be as follows: PET layer—aluminum foil layer—paper layer or alternatively PET layer—aluminum foil layer—paper layer—aluminum foil layer—PET layer.

According to the kind of foods to be cooked adjustment of thickness of the aluminum foil in the heating element enables adjustment of the browning characteristics. Metal such as aluminum generally reflect microwaves, thereby reducing heat efficiency, however, when the aluminum is very thin, the microwaves can penetrate it with the result that eddy current is produced therein which flows against the resistance of the foil to generate heat. The heating effect is most pronounced when the aluminum sheet is 50-60 angstroms in thickness.

The heating element may be formed as a layer on the sheet that is used to be folded into the box to form the vessel or it may be disposed in the vessel after the vessel has already been formed. Moreover, by providing a heat element sheet having a predetermined form, such as a lattice, various designs can be formed in the pattern of the browning on the outer surface of food.

The configuration of the food vessel may be cylindrical, rectangular parallelepiped, cubical, polygonal or essentially any other desired shape. A hole having a diameter of 1 to 3 mm which functions as a vent hole for preventing the vessel from swelling due to steam released by heated food therein is preferably provided, because, if no vent hole is formed in the vessel, the steam pressure within the vessel tends to deform it or to push the lid of the vessel up, and out of contact with the food to be heated.

The most efficient heating occurs at the position where the outer surface of the food is in contact with the heat element. It is therefore to be desired that the heat element attached on the inner surface of the vessel is kept in contact with the food during heating. Such contact therebetween is however unnecessary before baking in the microwave oven because the bread dough expands to approximately three times its precooked volume within one minute due to internal heating. It will be appreciated that smooth movement of the heat element on the lid section having the vent hole in accordance with swelling of the food so as to maintain contact therewith will cause food, such as bread, to brown evenly.

Various embodiments of a food vessel which are essentially modified forms of the first embodiment will be described hereinbelow.

Figure 5:
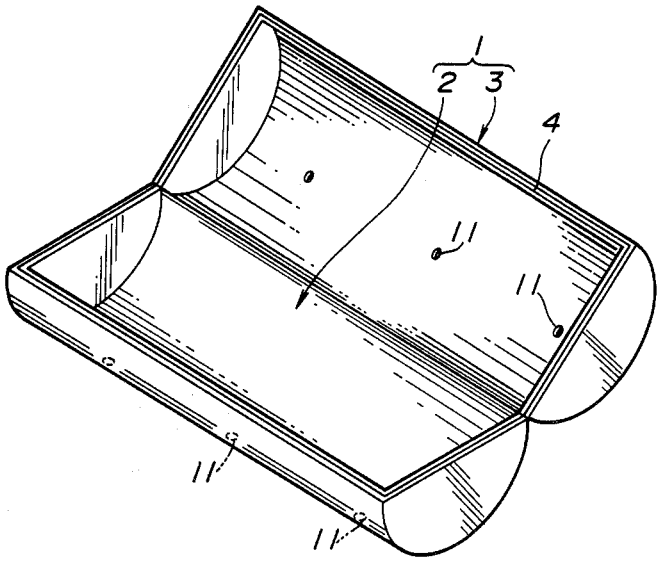
FIG. 5 is a perspective view of a food vessel of a second embodiment according to the invention.
Figure 6:
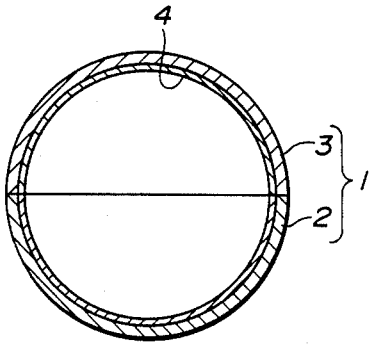
FIG. 6 is a section view of the vessel shown in FIG. 5.

Referring to FIGS. 5 and 6, there is illustrated a second embodiment of the invention which is a modified form of the first embodiment. A food vessel 1 for a microwave oven comprises a semi cylindrical vessel body 2 and a lid section 3 which is the same shape as the vessel body. The two halves are made of paper board. The vessel body 2 and the lid section 3 are blocked at each end thereof and pivotably connected to each other at an edge to open and shut. The volume of the closed vessel body formed by halves 2 and 3 is 1334 $cm^3$. Similarly to the first embodiment, a heat element 4 covers the entire interior surface of the vessel body 2 and the lid section 3 and vent holes 11 are also provided in each of them. In such a cylindrical vessel, the junction between the vessel and the lid tends be stronger than that of any of the differently shaped vessels and there are scarcely any openings, When dough is baked in the vessel in a conventional oven, the outer surface of the dough is heated prior to heating of the inside. Therefore, no steam is produced. The vent hole is therefore not needed. When the dough is however baked within the microwave oven, a lot of steam tends to be produced due to the internal heating of the dough. It should be noted that the above cylindrical vessel requires the vent hole in order to obtain effective baking.

In order to determine the efficiency of the food vessels of the first and second embodiments, experiments were performed by using the each vessels to bake bread, wherein 470 g of dough having the ingredients set forth in the table 1 below were put into the respective vessels and were heated for four minutes in a microwave oven (500W) after first being allowed to rise. The result of the first experiment using the rectangular parallelepiped vessel of the first embodiment showed that the upper surface of the baked bread was swollen, the bread was browned uniformly and had no uneven projections on its surface. Similarly, in the second experiment using the hollow cylindrical vessel of the second embodiment, the bread was also browned uniformly.

TABLE 1

| ingredients | weight (%) |
|---|---|
| wheat flour | 53 |
| salt | 10 |
| sugar | 2 |
| skim milk | 1 |
| shortening | 2 |
| dry yeast | 0.6 |
| water | 31.4 |

Figure 8:
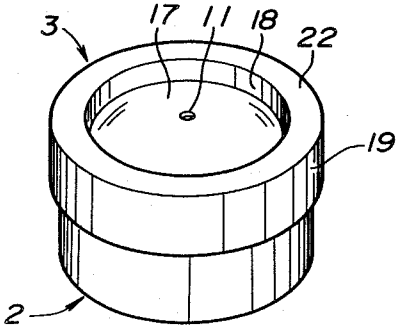
FIG. 8 is a perspective view of the vessel shown in FIG. 7.
Figure 7:
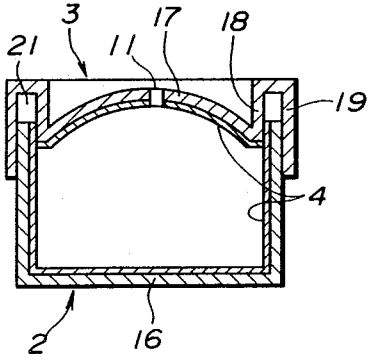
FIG. 7 is a section view showing a food vessel of a third embodiment according to the invention.

Referring to FIGS. 7 and 8, there is illustrated a third embodiment of the invention. A vessel body 2 takes the form of a hollow cylinder having a bottom plate 16. A heat element 4 which is the same as that of the aforementioned embodiments is attached on the inner surface of the vessel body 2. A lid section 3 comprises a hemispherically shaped section 17, a ring-shaped inner wall 18 an edge of which is connected with that of the hemispherical section, and a ring-shaped outer wall 19 an edge of which is connected with another edge of the inner wall 18 via a circular plate 22. A vent hole 11 is provided at the center of the section 17. A groove 21 for partly receiving a side wall of the vessel body 2 is defined by the inner and the outer walls 18 and 19. The upper section of the side wall of the vessel body 2 is inserted into the groove 21. A heat element 4 is attached to the inner surface of the hemi-spherically shaped section 17.

Figure 9:
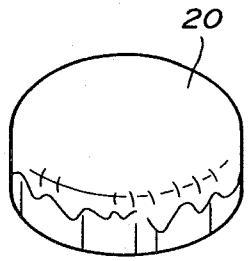
FIG. 9 is a perspective view of bread baked by means of the vessel of FIG. 8.

In such a food vessel, if a predetermined volume of bread dough is put into the vessel and is heated in a microwave oven, the bread rises, thereby causing the outer surface of the bread to contact the heat element 4 and push up the lid section 3 due to the expansion of the dough. It will be appreciated that the bread browns uniformly in the vessel, the upper section of the bread 20, as shown in FIG. 9, is in the form of a hemi-sphere similar to that of the section 17, and lower section thereof is in the form of a cylinder.

Figure 11:
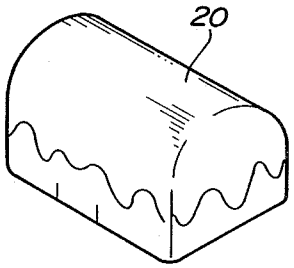
FIG. 11 is a perspective view of bread baked by means of the vessel of FIG. 10.
Figure 10:
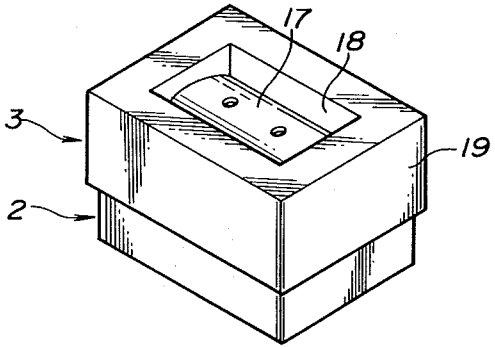
FIG. 10 is a perspective view of a food vessel of a fourth embodiment according to the invention.

Referring to FIG. 10, there is illustrated a fourth embodiment of the invention. A food vessel for a microwave oven comprises a rectangular parallelepiped vessel body 2 and a rectangular parallelepiped lid section 3. A semi-cylindrical section 17 is formed in the lid section 3. Similar to the third embodiment shown in FIG. 8, an inner side wall 18 and an outer side wall 19 is provided around the half cylindrical section 17 to form the lid section 3. A heat element is attached on the inner surfaces of the vessel body 2 and the semi-cylindrical section 17 of the lid section 3. The other elements are the same as the third embodiment shown in FIG. 8. It will be appreciated that a rectangular parallelepiped loaf of bread 20, as can be seen in FIG. 11, whose upper section takes form of a half cylinder can be produced.

Figure 14:
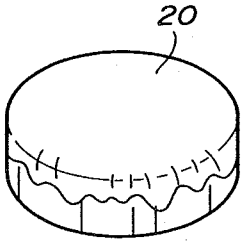
FIG. 14 is a perspective view of bread baked by means of the vessel of FIG. 13.
Figure 13:
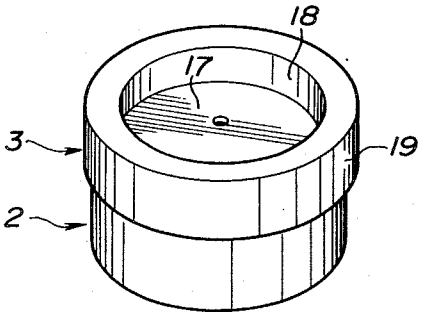
FIG. 13 is a perspective view of the vessel of FIG. 12.
Figure 12:
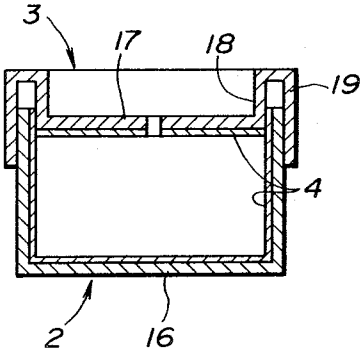
FIG. 12 is a section view of a food vessel of a fifth embodiment according to the invention.

Referring to FIGS. 12 and 13, there is illustrated a fifth embodiment of the invention. A food vessel comprises a lid section 3 of which a recess has a flat circular plate 17. The construction is otherwise similar to that of the third embodiment of the invention shown in FIGS. 7 and 8. It will be appreciated that a disc shaped loaf of bread 20, as shown in FIG. 14, having a flat circular surface can be produced. Alternatively, by providing a food vessel having a small volume, for example, 40 $cm^3$, a cracker can be baked. Experiments were performed with this vessel to bake crackers, wherein 35 g of dough of the ingredients as set forth in the table 2 below were put into the vessel and were heated for two minutes in a microwave oven (500W). The result of the experiment showed that a uniformly browned cracker with even surface was produced.

TABLE 2

| ingredients | weight (g) |
|---|---|
| wheat flour | 500 |
| salt | 0.5 |
| sugar | 150 |
| butter | 125 |
| baking powder | 1.5 |
| milk | 250 |

Figure 16:
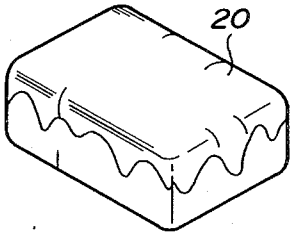
FIG. 16 is a perspective view of bread baked by means of the vessel of FIG. 15.
Figure 15:
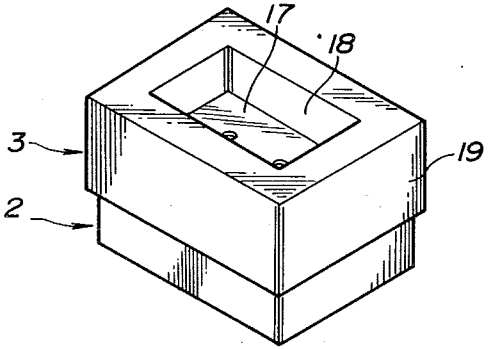
FIG. 15 is a perspective view of a food vessel of a sixth embodiment according to the invention.

Referring to FIG. 15, there is illustrated a sixth embodiment of the invention. The food vessel according to the embodiment is similar in form to the one of the fourth embodiment shown in FIG. 10 except that a flat rectangular plate 17 is provided on the lid section 3. It will be appreciated that a rectangular parallelepiped loaf of bread 20, as shown in FIG. 16, having a rectangular flat surface can be produced with this embodiment.

Figure 17:
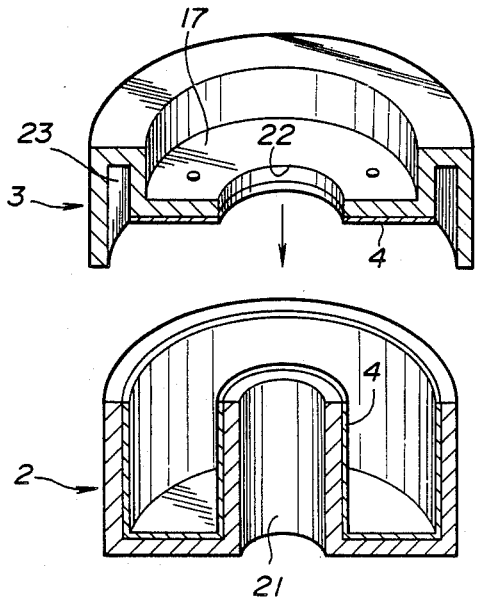
FIG. 17 is a section view of a food vessel of a seventh embodiment according to the invention.
Figure 18:
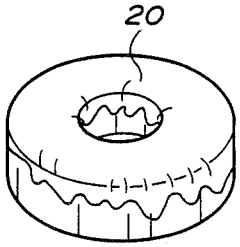
FIG. 18 is a perspective view of bread baked by means of the vessel of FIG. 17.

Referring to FIG. 17, there is illustrated a seventh embodiment of the invention. A hollow cylindrical section 21 is formed in the center of the vessel body 2. The lid section 3 has a recess portion having a flat bottom 17. The bottom 17 has an opening 22 at the center thereof. The opening 22 is positioned so as to allow the slidable insertion of an edge section of peripheral wall of the vessel body 2 into a groove 23 formed in the lid section 3 when the cylindrical section 21 is inserted into the opening. A heat element 4 is attached on the inner surfaces of the vessel body 2 and the bottom 17. The other elements are the same as the third embodiment shown in FIG. 7. It will be appreciated that a doughnut shaped loaf of bread 20 as shown in FIG. 18 can be produced by means of this vessel.

Figure 19:
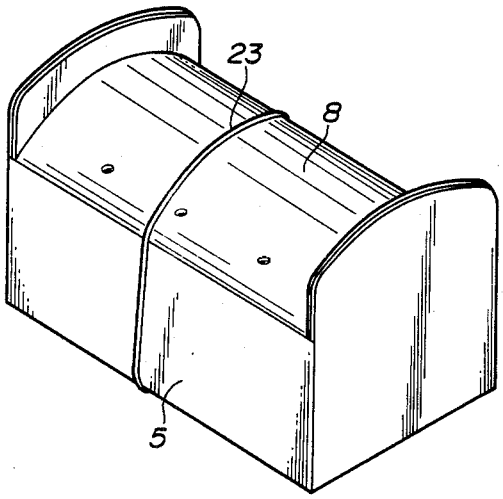
FIG. 19 is a perspective view of a food vessel of a eighth embodiment according to the invention
Figure 20:
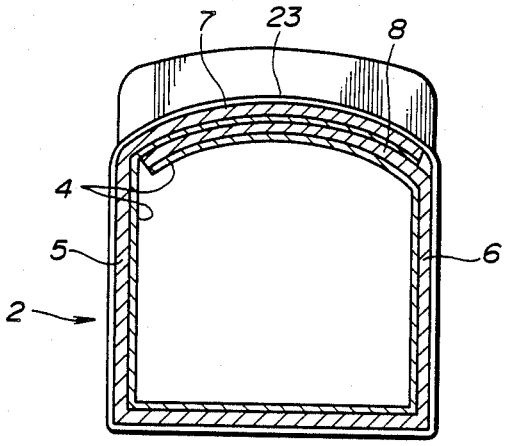
FIG. 20 is a sectional view of the vessel shown in FIG. 19.

Referring to FIGS. 19 and 20, there is illustrated an eighth embodiment. The food vessel according to this embodiment is basically the same as that of the first embodiment except for the construction of lid members 7 and 8. The lid members 7 and 8 are provided at edges of opposing side walls 5 and 6. The length of the lid member 7 and 8 is equal to that of the side walls 5 and 6 and the width of the lid members 7 and 8 is approximately equal to that of the bottom of the vessel body 2. A heat element 4 is attached on the inner surfaces of the lid members 7 and 8 and vessel body 2.

In this construction, bread dough is put into the vessel body 2 and then the lid members 7 and 8 are closed thereover so as to overlap and an elastic band 23 is stretched over the vessel body 2 to prevent the lid members 7 and 8 from opening. It will be appreciated that when the bread dough put into the vessel body 2 rises, the surface of the bread dough comes in contact with the heat element 4 to push up the lid members 7 and 8 against the restraining pressure of the elastic band 23 and a loaf of bread whose shape is the same as that shown in the first embodiment can be produced.

The invention may be embodied in other specific forms without departing from the spirit or essential characteristics set forth in the appended claims thereof. The above embodiments are therefore to be considered in all respects as illustrative and not restrictive, the scope of the invention being indicated by the appended claims rather than by the foregoing description and all changes which come within the meaning and range of equivalency of the claims are therefore intended to be embraced therein.

What is claimed is:

1. A food vessel for baking an expandable food in a microwave oven comprising:

providing an expandable food product;

a heat resistant vessel body having an opening and a lid for covering said opening containing said expandable food, said body allowing said expandable food to expand therein; and a heating means including heating element which is arranged on the inner surfaces of said vessel body and said lid, operative to maintain contact with the outer surface of said expandable food during expansion thereof to obtain a uniform browned surface, said heating means being responsive to irradiation of microwaves by said oven to generate heat for baking said expandable food in said vessel body.

2. A vessel as set forth in claim 1, wherein said expandable food is dough and wherein said lid is movable so as to maintain contact between said heating element provided on the inner surface thereof and the outer surface of said rising dough during heating in the oven.

3. A vessel as set forth in claim 2, wherein said lid is deformable according to swelling of said dough.

4. A vessel as set forth in claim 1, wherein said lid has at least one hole which functions as a vent hole for preventing said vessel from swelling due to steam released by the heated expandable food therein.

5. A vessel as set forth in claim 1, wherein said heating element is a dielectric element.

6. A vessel as set forth in claim 5, wherein eddy currents are generated in said heating element by irradiation of microwaves by said oven.

7. A vessel as set forth in claim 5, wherein said dielectric element comprises aluminum foil.

8. A vessel as set forth in claim 5, wherein said heating element is in the form of a laminated sheet which is made of polyester film, aluminum foil, and paper.

9. A vessel as set forth in claim 8, wherein the thickness of said aluminum foil is 50 to 60 angstroms.

10. A vessel as set forth in claim 5, wherein said heating element is in the form of a laminated sheet which is made of polyethylene terephthalate, aluminum, and paper.

11. A food vessel for baking an expandable food in a microwave oven comprising:

providing an expandable food product;

a vessel body having an opening, said vessel body receiving said expandable food therein;

a lid section for covering said opening, said lid section being movable so as to allow said expandable food to expand in said vessel body; and heating means including a heating element, which is attached on the inner surfaces of said vessel body and said lid section and provided so as to maintain contact with the outer surface of said expanding food product to obtain a uniform brown surface wherein the temperature of said heating element can be brought to a desired value, by irradiation of microwaves by said oven, to bake said dough.

12. A vessel as set forth in claim 11, wherein said lid has at least one hole which functions as a vent hole for preventing said vessel from swelling due to steam released by the heated expandable food therein.

13. A vessel as set forth in claim 11, wherein said lid section is flexible for accommodating expansion of said expandable food.

14. A vessel as set forth in claim 11, wherein said heating element is provided on the inner surfaces of said vessel body and said lid section so as to maintain contact with said expandable food during heating.

15. A vessel as set forth in claim 11, wherein said heating element takes the form of a sheet which comprises at least one kind of dielectric material.

16. A vessel as set forth in claim 15, wherein the thickness of said sheet may be selected for producing a desired thermal response to microwave irradiation.

17. A vessel as set forth in claim 15, wherein said heating element is made of polyester film, aluminum foil, and paper.

18. A vessel as set forth in claim 17, wherein said heating element is formed of laminated sheets of polyester film, aluminum foil, paper, polyester film, aluminum, paper arranged in sequence.

19. A vessel as set forth in claim 15, wherein said heating element is made of polyethylene terephthalate, aluminum, and paper.

20. A vessel as set forth in claim 19, wherein said heating element is formed of laminated sheets of polyethylene terephthalate, aluminum foil, paper, polyethylene terephthalate, aluminum, paper in sequence.

21. A vessel as set forth in claim 19, wherein said heating element is formed of laminated sheets of polyethylene terephthalate, aluminum foil, paper, aluminum, polyethylene terephthalate, arranged in sequence.

22. A vessel as set forth in claim 11, wherein said lid section comprises two lid members connected to the edge of said vessel body which lid members overlap to cover the opening of said vessel.

23. A vessel as set forth in claim 22, wherein said lid members have a plurality of strip sections the ends of which are arranged so as to alternately overlap.

24. A vessel as set forth in claim 22, wherein said vessel body is in the form of a generally rectangular parallelepiped box.

25. A vessel as set forth in claim 11, wherein said vessel body is made of a heat resistant paper board.

26. A vessel as set forth in claim 11, wherein said vessel body takes the form of a half cylinder whose ends are blocked and said lid section takes form of a half cylinder whose ends are blocked, said vessel body and said lid section are pivotably connected to each other at an edge thereof to open and shut.

27. A vessel as set forth in claim 11, wherein said lid section has a groove for slidably receiving an edge of said vessel body so as to allow said dough to rise during heating.

28. A vessel as set forth in claim 27, wherein said vessel body is in the form of a approximately rectangular parallelepiped box and a section of said lid is semi-cylindrical.

29. A vessel as set forth in claim 28, wherein the major portion of said lid is flat.

30. A vessel as set forth in claim 27, wherein said vessel body is generally cylindrical and a section of said lid is hemi-spherical.

31. A vessel as set forth in claim 30, wherein the major portion of said lid is flat.

32. A vessel as set forth in claim 30, wherein said vessel body includes a hollow cylindrical portion provided at the center thereof and said lid includes an opening positioned so as to partly receive the end of said cylindrical portion wherein the space defined within said food vessel is generally toroidal.

* * * * *